US006880172B2

(12) United States Patent
Quintero

(10) Patent No.: US 6,880,172 B2
(45) Date of Patent: Apr. 19, 2005

(54) BASEBALL PROTECTOR FOR INSIDE OF THE WRIST, FOREARM AND BICEP

(76) Inventor: Jacob T. Quintero, 128 W. Grand Blvd., Corona, CA (US) 92882

( * ) Notice: Subject to any disclaimer, the term of this patent is extended or adjusted under 35 U.S.C. 154(b) by 196 days.

(21) Appl. No.: 10/238,238

(22) Filed: Sep. 10, 2002

(65) Prior Publication Data

US 2004/0045079 A1 Mar. 11, 2004

(51) Int. Cl.[7] ..... A41D 13/08
(52) U.S. Cl. ..... 2/16
(58) Field of Search ..... 2/16, 455, 6.4, 2/6.5, 411, 414

(56) References Cited

U.S. PATENT DOCUMENTS 2,082,574 A 6/1937 Handley
3,924,272 A 12/1975 Allen et al.
D290,766 S 7/1987 Pierce, Jr.
5,715,535 A * 2/1998 Hamilton et al. ..... 2/59
6,076,185 A * 6/2000 Schramm ..... 2/16
6,094,743 A 8/2000 Delgado
6,098,208 A 8/2000 Cordon
6,128,777 A 10/2000 Foreman
6,380,048 B1 4/2002 Boon et al.

* cited by examiner

*Primary Examiner*—Peter Nerbun
*Assistant Examiner*—Brian Kauffman
(74) *Attorney, Agent, or Firm*—Stetina Brunda Garred & Brucker

(57) ABSTRACT

A baseball protector for protecting the arm of a user, having a forearm protector and a bicep protector connected to each other by a linking member. The forearm protector has an elastic sleeve having an impact absorption pad covering the inside of the user's forearm. The elastic sleeve has a contracted elastic band at its upper end to prevent the forearm protector from slipping down or off the forearm. The bicep protector has an impact absorption pad for covering the bicep of the user's arm and an elastic band at an upper end. The linking member is formed of elastic strips or a sheet member which does not restrict the throwing and/or catching motion of the user.

6 Claims, 2 Drawing Sheets

BASEBALL PROTECTOR FOR INSIDE OF THE WRIST, FOREARM AND BICEP

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to a baseball protection equipment, and more particularly, to a baseball protector providing protection over the inside portion of the wrist, forearm and bicep of a baseball catcher.

Various kinds of baseball protection equipment have been developed to minimize the injury caused by impact of the baseball. For example, the mask and chest protector are typically worn by the catcher to protect the direct impact to the face and the chest. Other protectors such as helmets, knee pads, leg/shin guards and even thumb protectors can also be found to provide protection in various areas of the players.

Among all the players participating in a baseball game, the catcher requires the most comprehensive protection. As mentioned above, a helmet, knee pad, chest protector, face mask, leg/shin guard, and the knee pads have been utilized to minimize direct impact of the baseball with the catcher. However, as is well known, catchers are required to catch the incoming ball thrown from any direction with any speed and orientation. In many situations, the inside of the forearm and the biceps of the catcher face the incoming ball directly, particular for catching a ball having a low trajectory approaching home plate or from a foul tip. However, currently, a protector that thoroughly protects the inside of the forearm, the wrist and the bicep of the catcher without restricting the catcher's throwing and/or catching motion have not been developed.

SUMMARY OF THE INVENTION

The present invention provides a baseball protector for protecting the inside of the wrist, forearm, and bicep of a player, particularly useful for a baseball catcher. The baseball protector includes a forearm protector and a bicep protector connected to each other by an elastic linking member. The forearm protector has a protective impact absorbing pad covering at least the inside of the forearm, while the bicep protector also has an impact absorbing pad for absorbing impact directly applied to the bicep. The linking member is preferably formed as a bendable and flexible strip or fabric sheet material without covering the elbow.

In one embodiment, the bicep protector further comprises a pocket formed of a pair of sheet members to enclose the impact absorption pad therein. An elastic band is preferably provided at an upper end of the sheet members. The forearm protector includes an elastic sleeve. The sleeve has an inner sheet member in which the impact absorption pad is inserted and an elastic outer sheet member. The sleeve additionally has an elastic upper end. The elastic band of the bicep protector and the elastic upper end of the forearm protector prevent the baseball protector from slipping down or off the arm, particularly during a catching or throwing motion.

In a form of elastic strips or sheet members, the linking member does not cover the elbow, such that the motion of the elbow is not restricted thereby. The impact absorption pad is preferably formed as either a foam pad or gel pad. Further, foam ribs can be formed on the impact absorption pad to provide additional impact absorption.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
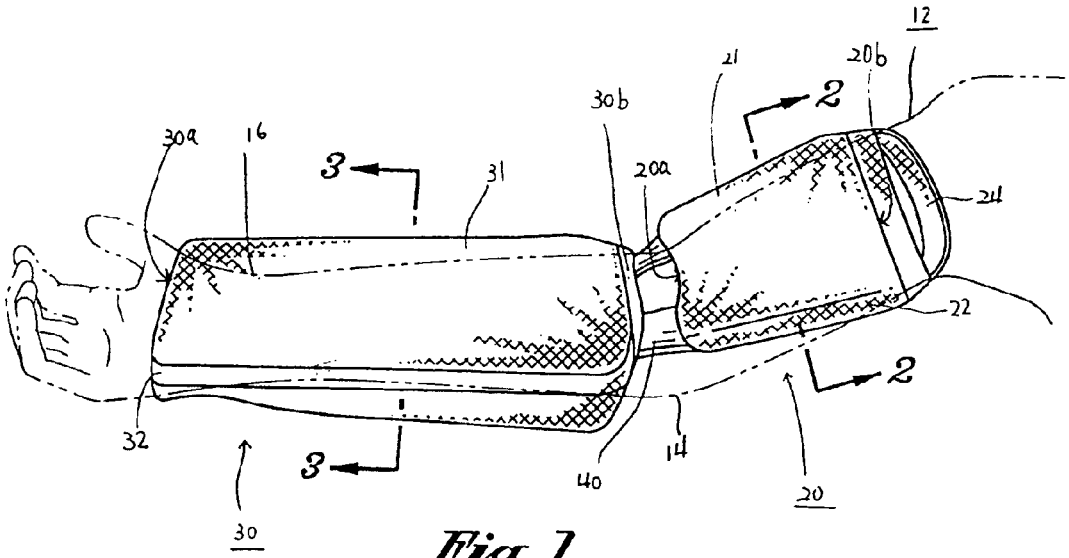
FIG. 1 shows a perspective view of a baseball protector provided by the present invention.
Figure 2:
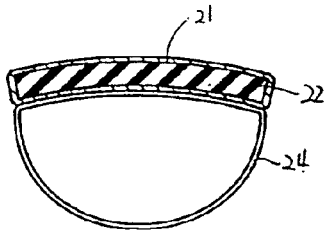
FIG. 2 shows a cross-sectional view taken along lines 2—2 of FIG. 1.
Figure 3:
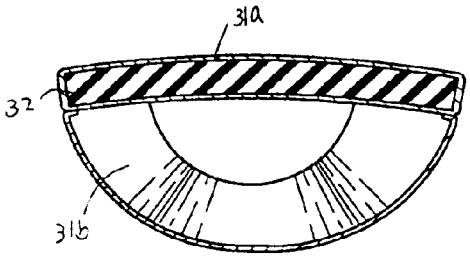
FIG. 3 shows a cross-sectional view taken along lines 3—3 of FIG. 1.

The present invention provides a baseball protector for protecting the inside of the forearm, the bicep and the wrist of a baseball player, particularly useful for a baseball catcher. Referring to FIG. 1, the baseball protector 10 is depicted disposed upon an arm 12 of a player/user; such as a baseball catcher. As shown, the protector 10 comprises a bicep protector 20, a forearm protector 30, and a linking member 40 connecting the bicep protector 20 and the forearm protector 30 together. As shown in FIG. 1, neither the bicep protector 20 nor the forearm protector 30 covers the elbow 14 of the user. In addition, the linking member 40 includes at least one elastic strip made of flexible and bendable material that does not irritate or restrict the motion of the user. Therefore, the necessary motions such as a throwing and/or catching motion of the catcher will not be restricted or affected thereby.

The bicep protector 20 comprises an impact or shock absorbing pad 22 inserted beneath a sheet member 21, preferably formed as a pocket made of flexible or elastic material which does not irritate or restrict the motion of the user. The bicep protector 20 has a lower end to be positioned in close proximity to and slightly above the elbow 14, an upper end 20*b*, and an elastic loop band 24 connected to the upper end 20*b*. The area of the bicep protector 20 from the lower end 20*a* to the upper end 20*b* is preferably formed large enough to cover substantially all of the bicep of the player. The elastic band 24 prevents the bicep protector 20 from slipping down or off the arm 12, particularly during a throwing and/or catching motion.

The forearm protector 30 preferably includes a flexible or elastic sleeve 31 and an impact or shock absorbing pad 32 inserted between a pair of sleeve members, i.e., one (inner) side 31*a* of the sleeve 31. As shown in FIG. 1, preferably, the impact absorbing pad 22 is disposed on the inside of the forearm which is vulnerable to impact from an incoming baseball. The forearm protector 30 has a lower end 30*a* extending over the wrist 16 of the user and an upper end 30*b* positioned closely under the elbow 14. Preferably, the upper end 30*b* is selectively constricted as by elastic to prevent the forearm protector 30 from slipping down or off the arm 12. In one embodiment of the present invention, the other (outer) side 31*b* of the sleeve 31 may include a pocket for inserting an additional impact or shock absorbing pad 22 therein. Thus, both inside and outside of the forearm of the user can be protected from being injured by the incoming baseball.

Figure 4:
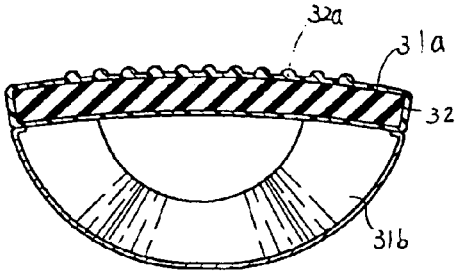
FIG. 4 shows a cross-sectional view taken along lines 3—3 as shown in FIG. 1 depicting an additional embodiment of the present invention.

FIG. 4 shows a cross sectional view of an additional embodiment of the forearm protector 30 taken along the cutting lines 3—3 of FIG. 1. In this embodiment, the impact absorbing pad 32 is formed having a plurality of foam and/or plastic ribs 32*a* for providing additional impact or shock absorption. Preferably, the shock absorption pads 22 and 32 are formed of either conventional gel pad or foam pad material.

Figure 5:
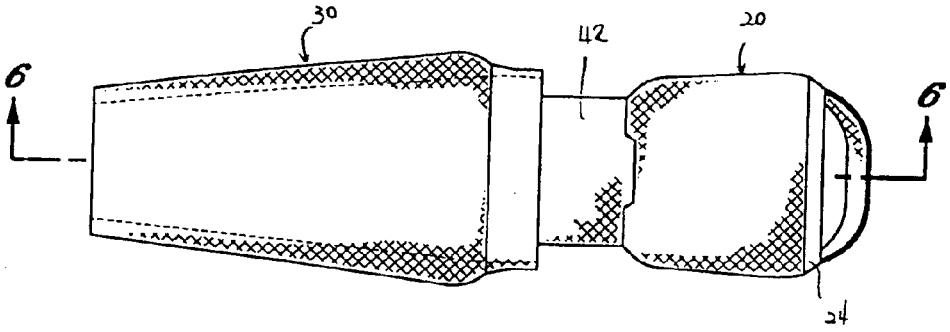
FIG. 5 shows a perspective view of an additional embodiment of the baseball protector of the present invention.
Figure 6:
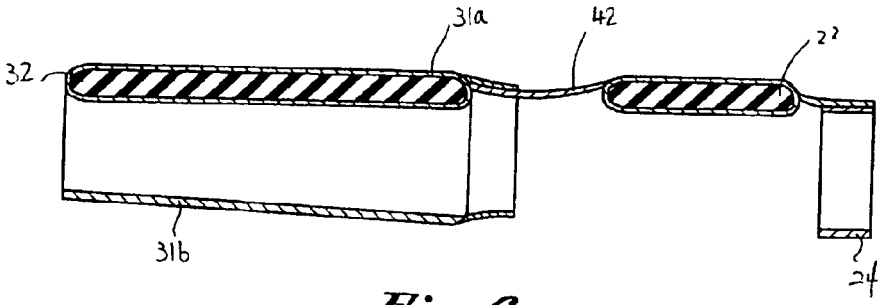
FIG. 6 shows a cross-sectional view taken along lines 6—6 of FIG. 5.

FIG. 5 shows the inside of a baseball protector 10 formed according to an additional embodiment of the present invention. As shown in FIG. 5, the bicep protector 20 and the forearm protector 30 are connected by a connecting sheet 42. The connecting sheet 42 connects the lower end 20*a* of the bicep protector 20 and the upper end 30*b* of the forearm protector 30. As best shown in FIG. 6, the connecting sheet 42 covers only the inside of the forearm protector 30 and the bicep protector 20, such that the motion of the elbow of the user will not be restricted or affected thereby.

As mentioned above, the baseball protector is designed for preventing the forearm and biceps of the user from being injured by the impact while catching the baseball. Therefore, the baseball protector is mainly used for the arm of the glove hand. However, it can also be applied to the throwing arm. While being applied to the throwing arm, the baseball protector may comprises the forearm protector only, such that the motion of the throwing arm will not be restricted.

Figure 7:
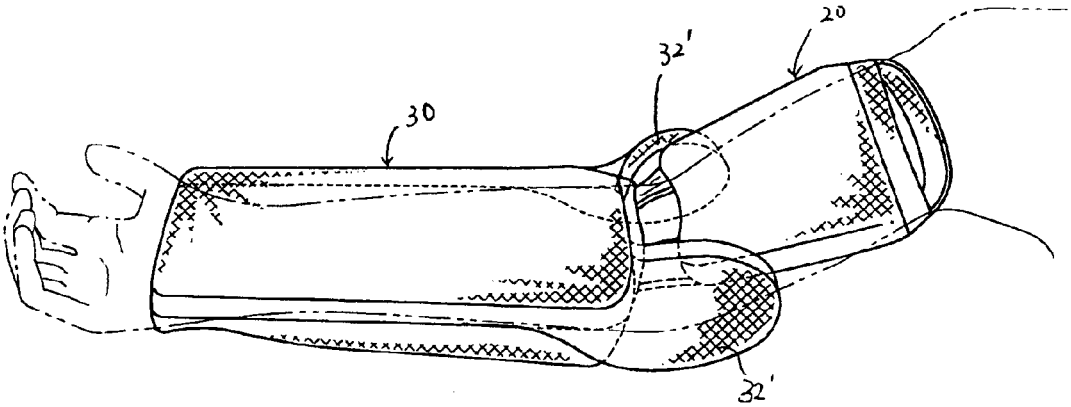
FIG. 7 shows a perspective view of an additional embodiment of the baseball protector of the present invention.

FIG. 7 shows another embodiment of a baseball protector according to the present invention. In addition to the bicep protector 20 and the forearm protector 30, this embodiment of the present invention includes two padded wings 32' which extend from the impact absorption pad 32 over the upper end 30*b* of the forearm protector 30 to cover both the inside and outside of the elbow 14. As the padded wings 32' merely cover the two sides of the elbow 14, the motion of the elbow 14 will not be affected or restricted thereby, while extra protection thereof is provided.

Indeed, each of the features and embodiments described herein can be used by itself, or in combination with one or more of other features and embodiment. Thus, the invention is not limited by the illustrated embodiment but is to be defined by the following claims when read in the broadest reasonable manner to preserve the validity of the claims.

What is claimed is:

1. A baseball protector for protecting an arm, comprising:

a forearm protector having an elastic sleeve, including an inner side covering the inside of a forearm and an outer side covering the outside of the forearm;

an impact absorption pad, inserted in the inner side of the elastic sleeve;

a contracted elastic band, at an upper end of the elastic sleeve;

a bicep protector having an impact absorption pad inserted in a sheet for covering the bicep of the arm and an elastic band, at an upper end of the bicep protector; and a linking member, connecting between the forearm protector and the bicep protector without covering the elbow of the arm wherein the linking member comprises a plurality of strips made of elastic material.

2. The baseball protector as recited in claim 1, wherein the forearm protector further comprises at least one padded wing extending from the impact absorption pad thereof to cover at least one side of the elbow.

3. The baseball protector as recited in claim 1, wherein the impact absorption pads include a plurality of foam ribs thereon.

4. The baseball protector as recited in claim 1, wherein the impact absorption pads include gel pads.

5. The baseball protector as recited in claim 1, wherein the impact absorption pads include foam pads.

6. The baseball protector as recited in claim 1, wherein the protector protects a forearm of a user and comprises an impact absorption pad covering the inside of the forearm.

* * * * *